US006764813B2

(12) United States Patent
Bhave et al.

(10) Patent No.: US 6,764,813 B2
(45) Date of Patent: Jul. 20, 2004

(54) LAMINATION OF EMISSIONS PREVENTION LAYER IN PHOTOTHERMOGRAPHIC MATERIALS

(75) Inventors: Aparna V. Bhave, Woodbury, MN (US); Karissa L. Eckert, Cottage Grove, MN (US); Kenneth W. Metz, Medford, OR (US); Lawrence B. Wallace, Newport, MN (US); Mridula Nair, Penfield, NY (US); Thomas M. Smith, Spencerport, NY (US); Barry M. Brown, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 11 days.

(21) Appl. No.: 10/150,607

(22) Filed: May 17, 2002

(65) Prior Publication Data

US 2003/0219674 A1 Nov. 27, 2003

(51) Int. Cl.[7] ..... G03C 1/498; G03C 1/74; G03C 1/795; G03C 11/22

(52) U.S. Cl. ..... 430/353; 430/207; 430/213; 430/403; 430/404; 430/496; 430/523; 430/533; 430/536; 430/617; 430/619; 430/961

(58) Field of Search ..... 430/353, 403, 430/404, 533, 536, 617, 619, 961, 523, 496, 207, 213

(56) References Cited

U.S. PATENT DOCUMENTS

| | | | |
|---|---|---|---|
| 3,457,075 | A | 7/1969 | Morgan et al. |
| 3,839,049 | A | 10/1974 | Simons |
| 3,997,346 | A | 12/1976 | Masuda et al. |
| 4,260,677 | A | 4/1981 | Winslow et al. |
| 4,407,938 | A | 10/1983 | Mizukura et al. |
| 4,452,883 | A | 6/1984 | Fenchik et al. |

(List continued on next page.)

FOREIGN PATENT DOCUMENTS

| | | |
|---|---|---|
| EP | 0 395 164 A | 10/1990 |
| FR | 2254047 | 11/1973 |

OTHER PUBLICATIONS

Research Disclosure, #17029, Jun. 1978.

Research Disclosure, #18431, Aug., 1979.

Research Disclosure, #42536, Sep. 1999.

Thermally Developable Photographic Materials (TDPM): A review of the State of the Art in Mechanistic Understanding, M.R.V. Sahyun, Image Science Tech. 1998, 42, 23.

Investigations of the Reactions Involved in Formation of the Light Sensitive Phases in Thermally Developed Photomaterials, Yu. E. Usaov & T. B. Kolesova, Journal of Imaging Science Tech., vol. 40, pp. 104110.

Early Dry Silver Technology at 3M, J.W. Shepard, Applied Photographic Engineering, vol. 8, Oct. 1982, pp. 210–212.

(List continued on next page.)

*Primary Examiner*—Richard L. Schilling
(74) *Attorney, Agent, or Firm*—Mark G. Bocchetti; Paul A. Leipold

(57) ABSTRACT

A photothermographic film and a method for making same is taught. The film includes a support, a photothermographic imaging layer coated on the support, and a complement film generally confining the photothermographic imaging layer between the support and the complement film. The complement film is applied to the photothermographic imaging layer prior to exposure of the photothermographic imaging layer. The complement film retains any volatile materials present in the photothermographic imaging layer generated when thermal energy is applied thereto to develop a latent image exposed on the photothermographic imaging layer.

52 Claims, 2 Drawing Sheets

U.S. PATENT DOCUMENTS

| | | | | |
|---|---|---|---|---|
| 4,569,898 | A | 2/1986 | Cottrell | |
| 4,614,681 | A | 9/1986 | Hayashi et al. | |
| 4,641,159 | A | 2/1987 | Seitz et al. | |
| 4,741,992 | A | 5/1988 | Przezdziecki | |
| 4,835,086 | A | 5/1989 | Jain | |
| 4,885,225 | A | 12/1989 | Heller et al. | |
| 4,942,111 | A | 7/1990 | Wade et al. | |
| 5,229,247 | A | 7/1993 | McCarthy et al. | |
| 5,275,927 | A | 1/1994 | Pham et al. | |
| 5,308,739 | A | 5/1994 | Uytterhoeven et al. | |
| 5,312,681 | A | 5/1994 | Muys et al. | |
| 5,331,444 | A | 7/1994 | Biles | |
| 5,422,234 | A | 6/1995 | Bauer et al. | 430/619 |
| 5,429,907 | A | 7/1995 | Uytterhoweven et al. | |
| 5,534,397 | A | 7/1996 | Anderson et al. | |
| 5,663,033 | A | 9/1997 | Warner et al. | |
| 5,773,386 | A | 6/1998 | Langan | |
| 5,814,430 | A | 9/1998 | Daems et al. | |
| 5,939,249 | A | 8/1999 | Zou | |
| 5,989,796 | A | 11/1999 | Moon | 430/619 |
| 6,090,747 | A | 7/2000 | Dronzek | |
| 6,124,236 | A | 9/2000 | Mitchell, Jr. | |
| 6,352,819 | B1 | 3/2002 | Kenney et al. | 430/619 |
| 6,352,820 | B1 | 3/2002 | Bauer et al. | 430/619 |
| 6,355,405 | B1 | 3/2002 | Ludemann et al. | 430/619 |
| 6,420,102 | B1 * | 7/2002 | Bauer et al. | 430/533 |
| 6,524,781 | B2 * | 2/2003 | Wada | 430/619 |

OTHER PUBLICATIONS

Mechanisms of Latent Image Formation in Photothermographic Silver Imaging Media, Chaofeng Zou & M.R. V. Sahyun, Journal of Imaging Science and Technology, vol. 40, Mar./Apr. 1996, pp. 94–103.

Thermally Processed Silver Systems, Donhald Klosterboer, Imaging Processes and Materials, (Neblette's Eight Edition), New York 1989, Chapter 9, pp. 279,291.

T.H. James, The Theory of the Photographic Process, Chapter 13—The Mechanism of Development, Pp 373–374.

Modern Coating and Drying Technology, VCH, New York 1992, E.d. Cohen & E.B. Gutoff.

Coating and Drying Defects, Troubleshooting Operating Problems, E. Gutoff, E. Cohen, John Wiley & Sons.

Unconventional Imaging Processes, Eric Brinckman, Gerard Delzenne, Albert Poot, Josef Willems, pp. 74–75.

Shiego, et al, Nippon Kagaku Kaishi, 1994, No. 11, pp. 992–997.

* cited by examiner

LAMINATION OF EMISSIONS PREVENTION LAYER IN PHOTOTHERMOGRAPHIC MATERIALS

CROSS REFERENCE TO RELATED APPLICATIONS

FIELD OF THE INVENTION

The present invention relates generally to multilayer imaging media and, more particularly, to laminated photothermographic films.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet or infrared radiation) and developed by the use of thermal energy. These materials, also known as "dry silver" materials, generally comprise a support having coated thereon: (a) a photo-catalyst (that is, a photosensitive compound such as silver halide) that upon such exposure provides a latent image in exposed grains that is capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in-situ", for example, by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998)

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

The imaging arts have long recognized that the field of photo-thermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

Because development is carried out with heat, the design of photothermographic materials requires that both room temperature and elevated temperature properties as well as the distribution of constituents within the material be taken into account.

In photothermographic materials, only a small amount of silver halide is used to capture light and a non-photosensitive source of reducible silver ions (for example, a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, Unconventional Imaging Processes, E. Brinckman et al., Eds., The Focal Press, London and New York, 1978, pp. 74–75, in Zou et al., *J. Imaging Sci. Technol.* 1996, 40, pp. 94–103, and in M. R. V Sahyun, *J. Imaging Sci. Technol.,* 1998, 42, 23.

As noted above, thermographic and photothermographic materials generally include a source of reducible silver ions for thermal development. The most common sources of reducible silver ions are the silver fatty acid carboxylates. Other components in such materials include a reducing agent system that includes at least one reducing agent along with optional co-developers and contrast enhancing agents, and optional toning agents (common ones being phthalazine, phthalazinone, and derivatives thereof) in one or more binders (usually hydrophobic binders). These components are generally formulated for coating using polar organic solvents.

During thermal development various by-products and film components are released from the photothermographic material. These byproducts and film components, including various fatty carboxylic acids (such as behenic acid), reducing agent(s), and toners, can diffuse out of the material and build-up within the thermal processing equipment (such as on processor platens, rollers, and drums). It is important to prevent the build-up of such debris within the processing equipment since it may result in the processed material sticking to the various mechanisms and causing machine jams and scratches on the surface of the developed materials.

These by-products can also build up in the imaging section of the machine and lead to image artifacts, thus impairing the quality of the image. This can be particularly critical in films designed for medical imaging applications. Service calls and machine downtime result.

During transport through imaging and processing equipment, thermographic and photothermographic coatings can be damaged by contact with mechanisms such as rollers, guides, and diverter bars within the processor. One such type of damage occurs when edges of the material rub against solid surfaces within the processor. Tiny pieces of the emulsion or topcoat may be removed and collect in various places within the processor. This debris can also cause machine jams and can build up in the imaging section of the machine and lead to image artifacts. Again, service calls and machine downtime result.

Scratches are another defect seen on imaging films. The rubbing of unimaged film on previously deposited debris or on mechanical parts within an imager is one mode of creating scratches on the surface of the imaging material. In addition, scratches can be generated during the manufacture of the photothermographic film, during roll-up or during sheeting and packaging operations.

Another type of damage, referred to as "edge peel-back" occurs when the leading edge of the developed material contacts diverter bars or guides directly after processing. The film, which is still hot from the preceding processing step, displays different physical characteristics from those at room temperature. The interaction between the diverter bar and the developed material can result in the topcoat layer being "peeled back" from the support. At the same time, the emulsion layer is also pushed back from the support. This damages the leading edge of the material and is objectionable to the user. Edge peel-back also contributes to build-up of debris within the machine.

U.S. Pat. No. 5,422,234 (Bauer et al.) and U.S. Pat. No. 5,989,796 (Moon) describe the use of a surface overcoat layer in photothermographic materials to reduce the emission problems noted above. This overcoat layer comprises gelatin, poly(vinyl alcohol), poly(silicic acid) or combinations of such hydrophilic materials. While these overcoat layer materials provide suitable barriers to diffusion of reagents from the materials, they are typically coated from water. Coating a separate hydrophilic layer from water when the imaging layer(s) are generally coated from polar organic solvents is not desirable for a number of reasons.

While polyacrylates and cellulosic materials can also be used as barrier layer materials to provide physical protection, they do not adequately prohibit diffusion of all by-products of thermal development out of the thermographic and photothermographic materials.

Polymeric barrier layers to reduce emissions from thermographic and photothermographic films are described in U.S. Pat. No. 6,352,819 (Kenney et al.), U.S. Pat. No. 6,352,820 (Bauer et al.), and U.S. Ser. No. 09/916,366 (filed Jul. 27, 2001 by Bauer, Horch, Miller, Teegarden, Hunt, and Sakizadeh), all incorporated herein by reference. These barrier layers are all formed during coating of the heat-developable material and are either within the material or part of a topcoat layer. The barrier layers described therein do not provide any discussion of "edge peel-back."

U.S. Pat. No. 3,997,346 (Masuda et al.) teaches lamination of a photothermographic film to improve the print stability of the film. The film is laminated during or after imaging and thermal development with a polymer film layer that includes stabilizer compounds. A machine that incorporates this approach will, of necessity, have a source of imaging film and a stabilizing film, with attendant mechanisms for registration, edge trimming, etc. The approach described in this patent does not address the issue of reducing scratches that occur prior to the film processing stage. Furthermore, if as described in the patent, lamination is done after processing, it will not help address the problem of emissions from the photothermographic material during imaging and development.

U.S. Pat. No. 6,124,236 (Mitchell, Jr.) teaches a direct thermal printable media wherein a thermosensitive imaging layer is applied a back surface of a thin, optically transmissive film. A supporting substrate is thereafter affixed with an adhesive to the thermosensitive imaging layer to create a laminated structure with the thermosensitive imaging layer residing between the film and the supporting substrate.

There remains a need for photothermographic materials having suitable barrier layers that provide physical protection while further reducing the emission of various by-products and ingredients.

SUMMARY OF THE INVENTION

It is therefore an object of the present invention to provide a laminated photothermographic film that captures chemical emissions during the processing step when the film is transported over a heated drum.

It is a further object of the present invention to provide a laminated photothermographic film that has improved front-side scratch resistance.

Yet another object of the present invention is to provide a laminated photothermographic film that generally eliminates peel-back when developed.

It is a further object of the present invention to provide a laminated photothermographic film that substantially eliminates debris-related defects in radiographic film where the debris is generated due to abrasion of the coated film edge.

Briefly stated, the foregoing and numerous other features, objects and advantages of the present invention will become readily apparent upon a review of the detailed description, claims, and drawings set forth herein. These features, objects and advantages are accomplished by providing a photothermographic film with a complement film or web laminated thereon. The resulting laminated photothermographic film will include a support (preferably polyester). The support may include backside coating(s) of an antihalation dye, a transport matte agent and anti-static agents. The laminated photothermographic film will also include a photothermographic imaging layer. The photothermographic imaging layer is a silver-based layer that is coated on top of the support, either directly or with a carrier layer. In some situations, it may be advantageous to have a protective topcoat layer covering the silver-based photothermographic imaging layer. The complement film or web which is a pre-coated or uncoated support [such as, for example, polyethylene terephthalate (PET), polyethylene naphthalate (PEN), polypropylene, or polycarbonate)] is laminated to the uppermost surface of the photothermographic layer that is coated on top of the support. The laminated photothermographic film may further include a tie layer and/or an adhesive layer. The tie layer, if present, is a layer coated on top of the photothermographic imaging layer (or on top of the protective topcoat layer), either separately or simultaneously with the silver/topcoat. In such cases, the complement web is laminated the uppermost layer. The adhesive layer, if present, is preferably coated on the side of the complement film that is to be interfaced with the photothermographic imaging layer or to the tie layer for the purposes of adhesion therebetween. The combination of the adhesive layer and the complement film or web are sometimes collectively referred to herein as the overlam, or overlaminate. In addition, other functional layers designed to meet one or more needs, may be coated onto the complement film or web, on the side opposite to the adhesive layer. Such layers include gloss control layers, scratch resistant layers, image receptor layers, dye receptor layers, ink receptive layers, or release layers. It will be apparent to those skilled in the art that many such and other functional properties can be built into this layer(s).

Various coating methods may be employed to coat the various layers described herein, such as extrusion coating, forward and reverse roll coating, gravure coating, slide coating, and curtain coating. The choice of the coating method is dependent in large part on the type of solution being coated, the desired thickness, and the Theological properties of the coating solutions. Many such techniques are described in E. D. Cohen and E. B. Gutoff, *Modern Coating and Drying Technology*, VCH, New York, 1992, and in *Coating and Drying Defects: Troubleshooting Operating Problems*, E. B. Gutoff and E. D. Cohen, John Wiley and Sons, New York, 1995. It will be apparent to those skilled in the art to evaluate the various options available and pick the appropriate coating technique. It must be noted that the present invention is not tied to any one specific coating technique.

The overall thickness of the laminated photothermographic film is targeted to match that of commercial medical imaging films, which have an approximate thickness of 8 mil (203.2 em). The functional layers of these films are generally coated on a support that is 6.8 to 7 mil (172.7 to 177.8 μm) thick. A preferred method of preparing the laminated films of this invention is to laminate a 0.5–1.0 mil (12.7–25.4 μm) film of PET over a photothermographic film, to afford a laminated construction of between 8.5 to 9 mil (215.9 to 228.6 μm). It should be noted that this total thickness can also be achieved by using other combinations of complement web or film plus support thicknesses. For example, a support having a thickness of 6.5 mil (165.1 μm) may be used in combination with a complement web or film having a thickness of 0.5 mil (12.7 μm). In contrast, a support having a thickness of 3.5 mil (88.9 μm) may be used in combination with a complement film having a thickness of 3.5 mil (88.9 μm). In the practice of the present invention, for purposes of generating a desired stiffness of the film and resistance to edge peel back, the thickness of the complement film should be greater than 0.39 mil (10 μm) and preferably greater than 0.5 mil (12.5 μm). A maximum thickness for the complement film for a commercial medical imaging film product would be about 3.5 mil (85.75 μm). Those skilled in the art will recognize that any other combination of thicknesses to achieve the desired total thickness can also be chosen based on availability, cost and other criteria.

Once the photothermographic film has been exposed to generate a desired latent image thereon thermal energy is applied to the photothermographic film to develop the latent image. Substantially all of the volatile materials present in the photothermographic imaging layer generated during the step of applying thermal energy thereto are retained between the support and the complement film.

DETAILED DESCRIPTION OF THE INVENTION

Figure 1:
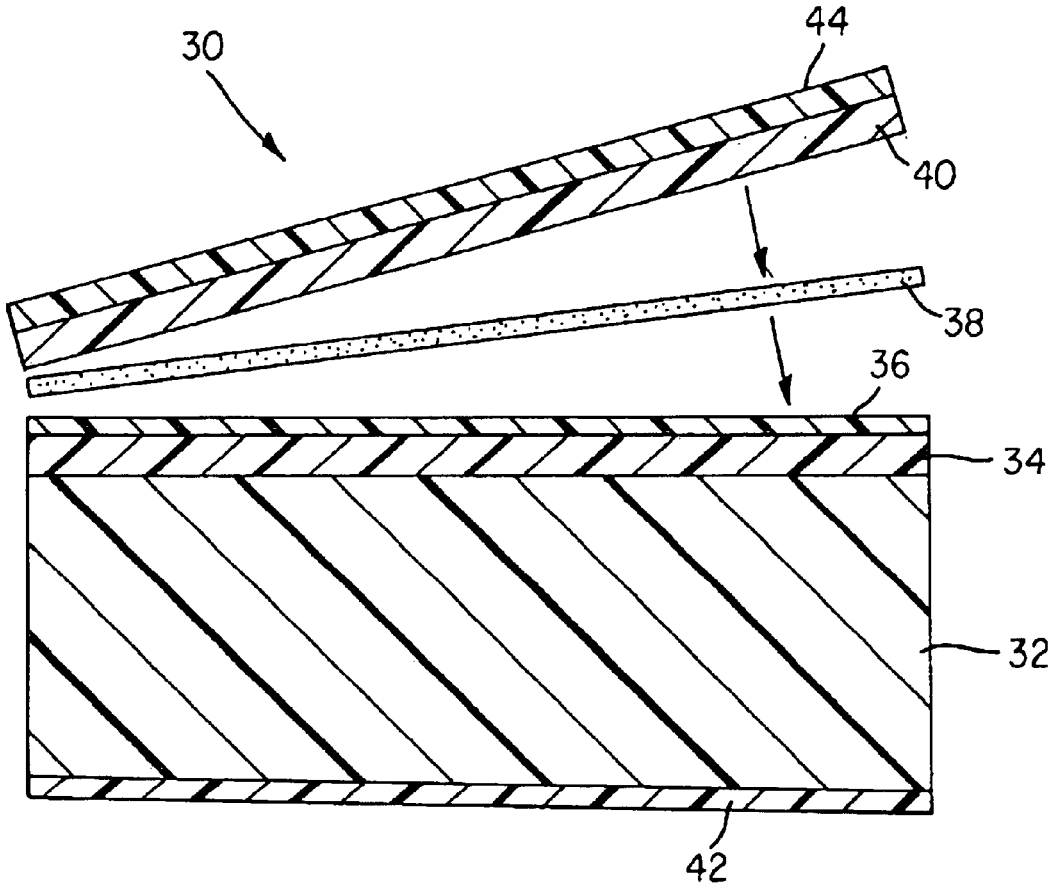
FIG. 1 is a cross-sectional view of a preferred embodiment of a laminated photothermographic film.

In the photothermographic materials used in this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same layer. "Catalytic proximity" or "reactive association" means that they are in the same layer or in adjacent layers.

Various layers are usually disposed on the "backside" (non-emulsion side) of the materials, including antihalation layer(s), protective layers, antistatic layers, conducting layers, and transport enabling layers.

Various layers are also usually disposed on the "fiontside" or emulsion side of the support, including protective topcoat layers, primer layers, interlayers, opacifying layers, antistatic layers, antihalation layers, acutance layers, auxiliary layers and others readily apparent to one skilled in the art.

As used herein the following terms are intended to have the following meanings:

In the descriptions of the photothermographic materials of the present invention, "a" or "an" component refers to "at least one" of that component.

Heating in a substantially water-free condition as used herein, means heating at a temperature of from about 50° to about 250° C. with little more than ambient water vapor present. The term "substantially water-free condition" means that the reaction system is approximately in equilibrium with water in the air, and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer," "imaging layer," "photothermographic imaging layer," or "photothermographic emulsion layer," means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Non-photosensitive" means not intentionally light sensitive.

"Transparent" means capable of transmitting visible light or imaging radiation without appreciable scattering or absorption.

"In-line" means that lamination and at least one coating step were accomplished in sequential operations and without intermediate winding and unwinding of the support.

"Off-line" means that lamination was conducted in a step separate from any coating step and required intermediate winding and unwinding of the support. In an off-line operation, the speed of coating and lamination can be different.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Looking first at FIG. 1 there is depicted a cross-sectional illustration of a preferred embodiment of the laminated photothermographic film 30 of the present invention. The laminated photothermographic film 30 includes a support 32. The support 32 is preferably polyester (for example, polyethyelene terephthalate), but can also be any other standard coating support such as polyethylene naphthalate, aluminum base, etc. Coated onto the support 32 is a photothermographic imaging layer 34 (which may be a multilayer composite) and a tie layer 36. An adhesive layer 38 is used to affix a complement film or web 40 to the photothermographic imaging layer 34 or to the tie layer 36. The material of the a complement film or web 40 can be chosen from commonly used support materials such as, for example, polyethylene terephthalate (PET), polyethylene naphthalate (PEN), polypropylene, and polycarbonate. The support 32 preferably includes a backside coating 42 with antihalation dye, transport matte agent and anti-static agents. The photothermographic imaging layer 34 is the silver-based imaging layer coated either directly on top of the support 32, or coated in combination with a carrier layer. In some embodiments, the photothermographic imaging layer 34 is a combination of a carrier layer, a silver-based imaging layer and a protective topcoat layer. Functional layer(s) 44, can also be coated on the complement film or web 40 on the side opposite to adhesive layer 38. This functional layer(s) 44 can be designed to meet one or more needs and may be, for example, a gloss control layer, a scratch resistant layer, an image receptor layer, an ink or dye receptor layer, or a release layer. It will be apparent to those skilled in the art that many functional properties can be built into this layer(s) 44.

As mentioned above, FIG. 1 depicts a cross-sectional illustration of a preferred embodiment of the laminated photothermographic film 30 of the present invention. However, in creating a laminated photothermographic film that meets the requirements of a specific product one or more of the layers depicted in FIG. 1 may be considered optional. For example, the tie layer 36 may be omitted with the adhesive layer 38 bonding the complement film 40 directly to the photothermographic imaging layer 34. Alternatively, the adhesive layer 38 may be omitted by extruding the complement film 40 directly onto the tie layer 36. Also, it is possible to eliminate both the tie layer 36 and the adhesive layer 38 by extruding the complement film 40 directly onto the photothermographic imaging layer 34. Layer 44 can also be omitted or can be designed to satisfy just one or more combination of the functions described above.

When an adhesive layer 38 is used the adhesive system that bonds the photothermographic imaging layer 34 to the complement film 40 it can be coated on top of the photothermographic imaging layer 34 with the tie layer 36 omitted, or on top of the tie layer 36, or on the complement film 40, or it can be a two-part adhesive system with a first part coated on the photothermographic imaging layer 34, or on top of the tie layer 36, and a second part coated on the complement film 40.

Lamination of the laminated photothermographic film 30 of the present invention can be practiced in either an in-line or an off-line mode. For example, in an in-line option, support 32 may be pre-coated with the photothermographic imaging layer 34 and the tie layer 36. Subsequently, the complement film 40 may be coated with the adhesive layer 38 and then bonded to tie layer 36. Thus lamination is in-line with the coating of adhesive layer 38. Similarly, if the tie layer 36 is eliminated, the support 32 may be pre-coated with the photothermographic imaging layer 34. Subsequently, the complement film 40 may be coated with the adhesive layer 38 and then bonded to photothermographic imaging layer 34. Again, lamination is in-line with the coating of adhesive layer 38. Another mode by which in-line lamination can be practiced is to pre-coat adhesive layer 38 onto complement film 40. Subsequently, support 32 may be coated with the photothermographic imaging layer 34 and the tie layer 36 with this resulting structure laminated to the pre-coated complement film 40. Here, lamination is in-line with the coating of photothermographic layer 34 and tie layer 36. A variation of this can also be practiced by, once again, eliminating the tie layer 36.

In an off-line mode, support 32 may be pre-coated with the photothermographic imaging layer 34 and, optionally, the tie layer 36. Similarly, complement film 40 may be pre-coated with adhesive layer 38. Next, the two pre-coated structures are laminated together off-line (that is, in an operation separate from the coating operations). This may be done either in a completely separate operation or in conjunction with a non-coating related operation such as, for example, a film slitting operation.

There are a number of lamination process and adhesive options that can be applied in the manufacture of the laminated photothermographic film 30 of the present invention.

Figure 2:
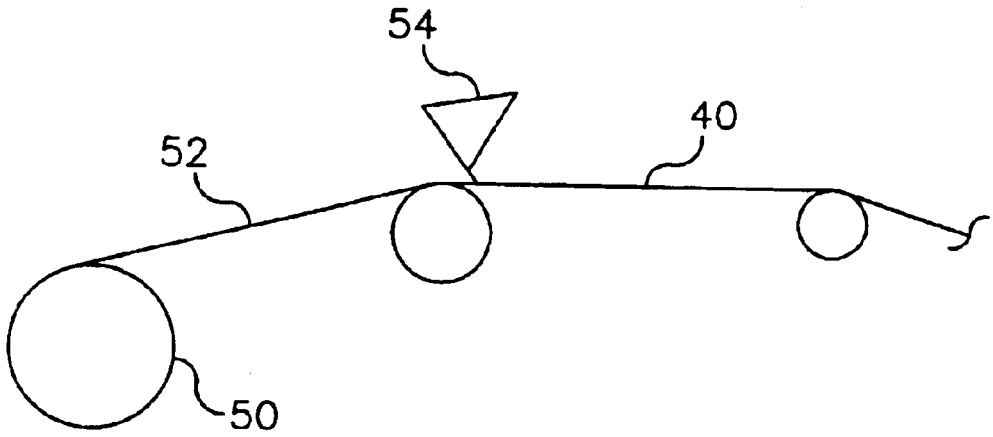
FIG. 2 is a process schematic of an extrusion lamination process.

In an extrusion lamination process such as is schematically depicted in FIG. 2, a roll 50 of a pre-coated support 52 including support 32, photothermographic imaging layer 34 and, optionally, the tie layer 36 as discussed with reference to FIG. 1 is unwound with the moving pre-coated support 52 travelling to an extruding station 54. The complement film 40 is extruded and while still molten is applied to the moving pre-coated support 52. By the very nature of this process, extrusion lamination has to be done in-line and downstream of the complement film extrusion. The complement film material that is extruded can be polyester, polyethylene, etc.

Figure 3:
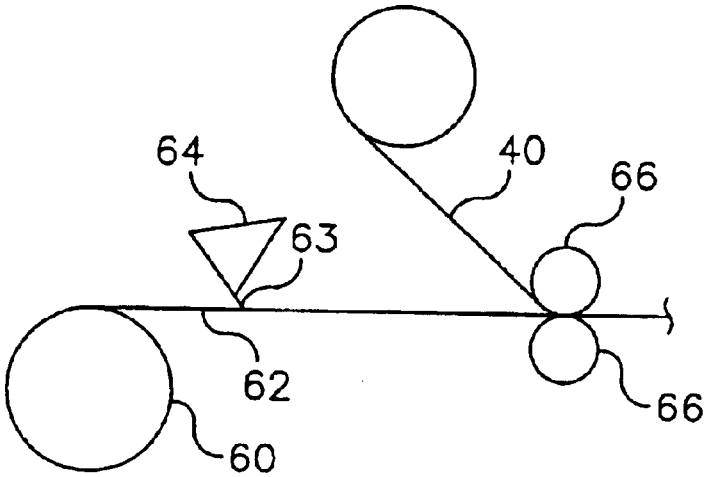
FIG. 3 is a process schematic showing of a second lamination process.

In an adhesive lamination process such as is schematically depicted in FIG. 3, a roll 60 of a pre-coated support 62 including support 32, photothermographic imaging layer 34 and, optionally, the tie layer 36 as discussed with reference to FIG. 1 has an adhesive 63 applied thereto by applicator 64. The pre-coated support 62 and the complement film 40 may then be a taken through a pair of nip rollers 66 to achieve a good bond. Although FIG. 3 shows the adhesive 63 being applied to the pre-coated support 62 it should be recognized that the adhesive 63 can be coated on either the pre-coated support 62 or on the complement film 40. Alternatively, a two-part adhesive system can be employed with one part coated on the pre-coated support 62 and another coated on the complement film 40. The adhesive itself can be of various types, based on the chemical composition of the layers interfacing with the adhesive layer 38 (see FIG. 1). These different types of adhesives can be broadly classified into: (a) heat activated adhesives, (b) pressure sensitive adhesives and (c) two-component curing adhesives.

Heat activated adhesives are designed to be non-tacky at room temperature. On heating, these adhesives soften or melt and allow a bond to form between the two components that are being laminated together. Due to the heat-sensitive nature of the photothermographic chemistry described herein, the heat activated adhesives have to soften/flow/develop tack at a sufficiently low temperature, approximately less than 190° F. (87.8° C.). The heat activated adhesive can be part of the tie layer 36 and/or the adhesive layer 38. Due to the non-tacky nature of heat activated adhesives at room temperature, the lamination process could be in-line or off-line. The heat activated adhesives looked at specifically for this application were mainly commercial copolymer adhesives, more specifically polyethylene/PET copolymer adhesives. Examples of these adhesives include: DigiSeal (available from USI Inc., Madison, Conn.), TransKote KRTY and TransKote OPP (available from Transil-Wrap Company, Inc., Franklin Park, Ill.), and Durafilm #12 (available from Graphics Laminating Inc., Solon, Ohio).

Pressure sensitive adhesives are tacky at room temperature. They can be applied in one of three modes. Pressure sensitive adhesives can be applied without a release liner only in an in-line operation, that is, the application of the pressure sensitive adhesive is performed as part of the lamination process where the complement film 40 is attached to the photothermographic layer 34 or tie layer 36 (see FIG. 1). Alternatively, pressure sensitive adhesives can be applied with a release liner either in an in-line or off-line operation. If a release liner is employed, then the adhesive, applied to photothermographic layer 34, tie layer 36 or to complement film 40, can be coated in a separate step from the lamination operation and/or other coating operation. In addition to release liners, it is also possible to use a complement film 40 that has a pre-coated release coating as a function layer 44. This coating would prevent blocking of the adhesive, and allow for in-line and off-line lamination. Commercial webs that are supplied in a precoated roll form can be utilized in this mode. Pressure sensitive adhesives such as acrylics and copolymers of ethyl vinyl acetate are particularly useful. Examples of some acrylics are Flexmark and Classics Plus webs from FLEXcon, Spencer, Mass. An example of an ethyl vinyl acrylate is Kodak PS UV Plus Gloss available from the Kodak Professional Division of Eastman Kodak Company (Rochester, N.Y.).

In another embodiment, the release coating described above can be formulated for the additional purpose of gloss control of the final product, or other functional properties described above.

The distinction between heat activated and pressure sensitive adhesives is often not a clear one. Thus, adhesives can have a moderate level of tack at room temperature and can display a significantly higher tack upon heating. Such adhesives can also be employed herein. Some types of adhesives in this category are: polyesters (VITEL® PE3200B from Bostik, Middleton, Mass.), polyvinyl acetates (VINAC® B-15 from Air Products and Chemicals, Allentown, Pa.), polyurethane/polyester blends (ESTANE® 5715 or ESTANE® 5703 from Noveon, Cleveland, Ohio blended with VITEL® PE5833 from Bostik, Middleton, Mass.), carboxylated syrene-butadiene copolymer latex (TYLAC® 68219-00 from Reichold Chemicals Inc., Research Triangle Park, N.C.), polyvinylmethylether, styrene-isoprene-styrene block copolymers (KRATON™ D 1107P from Shell Elastomers LLC, Houston, Tex.), and carboxylated vinyl acetate-ethylene copolymer in a polyvinyl (alcohol) emulsion (AIRFLEX® 920 from Air Products and Chemicals, Allentown, Pa.).

In addition to the release liners and coatings described useful as pressure sensitive adhesives, additives such as waxes or lubricants can be added to the adhesives to allow them to release from the complement film 40. For example ordinarily, AIRFLEX® 920 adhesive cannot be laminated off-line because it cannot be rolled up on itself. However, addition of 5–25% ULTRALUBE® E-390 (Ashland Specialty Chemical Company, Boonton, N.J.) to 40% solids of AIRFLEX® 920 permits the adhesive when coated on PET to be rolled up on itself. This allows for easy release and makes off-line lamination possible.

Curing adhesive systems can also be employed in forming the photothermographic film 30 of the present invention. Curing adhesive systems are two-component systems. When the two separate components are mixed, a cross-linking reaction is initiated and a bond is formed between the two layers contacted by the adhesive as the reaction is proceeds. There are two types of curing adhesive systems—solvent-based and solventless. Solvent-based curing systems are formulated as a solution or emulsion and involve a drying step after coating to eliminate the solvent. They can be coated either on top of photothermographic layer 34 or on complement film or web 40. Solventless curing systems are a 100% solids system and no drying step is required. These solventless adhesives are heated in order to melt them, and the subsequent melt is applied to either photothermographic layer 34 or to complement film 40. Curing adhesives tend to form strong bonds to whichever material they are contacted to prior to completion of curing. Hence, it is preferable to apply these adhesives in a step that is in-line with the subsequent step of lamination. Examples of solvent-based curing adhesives are: (1) isocyante terminated polyester urethanes having a coreacatant hydroxyl group, and (2) polyester adhesives having a coreactant isocyanate group.

Useful commercially available curing adhesives of represented by (1) above, include: NOVACOTE™ 222 with coreactant CR12 (Novacote Flexpack/Stahl, Peabody, Mass.) and TYCEL® 7900 with either TYCEL® 7283 or LA1063-92 coreactants (Lord Techmark, Wilmington, Del.). Commercially available curing adhesives represented by (2) above, include ADCOTE® 545 or ADCOTE® 102A with coreactant CT (Rohm and Haas, Philadelphia, Pa.). Examples of the solventless curing adhesive manufacturers are: Morton Thiokol, H. B. Fuller, and Novacote.

Some of these adhesives such as the polyurethane/polyester blends require a tie layer 36 to be coated over the photothermographic layer 34 in order to obtain acceptable adhesion of the complement film or web 40. This tie layer 36 can be a polyurethane/polyester blend, polyurethane, polyvinyl butyral, or an acrylic copolymer.

The adhesive layer may be further formulated by the addition of components that further assist the functionality of the product. For instance, print stabilizers, acutance dyes, and tint modifiers can be added to the adhesive layer 38 for the purposes of either reacting with the components of the photothermographic layer 34 or interacting with the light source used to expose the film 30.

It should be noted from the above discussion that a variety of adhesives can be used depending on the exact composition of the photothermographic layer 34. The choice of the best adhesive for the process depends on the end-application of the product. Nevertheless, the adhesive must satisfy certain conditions. It has to perform the function of bonding the photothermographic coating to the complement film. One method of determining if the adhesive forms a strong enough bond to be useful is to measure the peel strength of the complement film to the photothermographic material. The adhesive applied to the photothermographic layer 34 must not adversely effect the sensitometry of the photothermographic layer 34 under a wide variety of conditions (such as temperature, humidity, and storage) of use and storage. The adhesive cannot affect the visual characteristics (such as haze, tint or tone) of the film 30. This is especially critical when the photothermographic materials are to be used in medical imaging applications. Moreover, the adhesive also has to maintain its properties over time as the film 30 ages. The adhesive also should not develop defects upon coating and drying. It will be apparent to one skilled in the art that additional properties will have to be also evaluated for specific end-use of the product.

The materials that can be used for complement film or web 40 can be any material that can be used as a support for the photothermographic layer 34. These materials are preferably flexible films that have any desired thickness and are composed of one or more polymeric materials, depending upon their use. The materials for complement film or web 40 are preferably transparent, or at least translucent, but in some instances, opaque supports may be useful. They are required to exhibit dimensional stability during thermal development and to have suitable adhesive properties with overlying layers and with laminating adhesives. Useful polymeric materials for making the complement film or web 40 include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred complement film or web 40 materials are composed of polymers having good heat stability, such as polyesters and polycarbonates. Polyethylene terephthalate film is the most preferred complement film. Various materials useful as complement films are described, for example, in *Research Disclosure*, August 1979, item 18431. A method of making dimensionally stable polyester films for use as complement films is described in *Research Disclosure*, September 1999, item 42536. Complement film or web 40 materials may also be treated or annealed to reduce shrinkage and promote dimensional stability.

Opaque complement films such as dyed polymeric films and resin-coated papers that are stable at high temperatures can also be used. Reflective prints could thus be obtained from the same imaging chemistry.

Complement film or web 40 materials can contain various colorants, pigments, antihalation or acutance dyes if desired. They may be treated using conventional procedures (such as corona discharge) to improve adhesion of adhesive, of overlying layers, or of subbing or other adhesion-promoting layers.

Medical imaging films are often coated onto a blue tinted support. Worldwide, there are distinct regional preferences for different levels of tint. For example, radiologists in Europe prefer a bluer tint than that preferred by radiologists in the United States, while radiologists in Japan prefer a less blue tint. One advantage of using a complement film or web 40 is that the tint of the final photothermographic film 30 can be adjusted by varying the tint of the complement film or web 40 rather than that of the support 32. This provides advantages in manufacturing and inventory control in that only one support 32 need be coated.

For example, a 6.5 mil (165.1 $\mu$m) polyethylene terephthalate support 32 having a low b* value of 13.5 (where b* refers to the CIE L*a*b* calorimetric scale) can be coated with an antihalation dye-containing coating on the backside and photothermographic layer 34 on the front side without using a tie layer 36. Three exemplary polyethylene terephthalate complement film materials (layer 40) can be chosen: (a) clear 0.5 mil (12.7 μm) polyethylene terephthalate, (b) low b* 0.5 mil (12.7 μm) polyethylene terephthalate, and (c) medium b* 0.5 mil (12.7 μm) poly-ethylene terephthalate. Each of the three complement films 40 can be laminated to the photothermographic imaging layer 34 on a 6.5 mil (165.1 μm) low b* polyethylene terephthalate support 32 in each case creating the same end product but with different tints as controlled by the tint of the respective complement film 40.

The support 32 is a flexible film that has any desired thickness and can be composed of one or more polymeric materials, depending upon its use. The support 32 is generally transparent (especially if the material is used as a photomask) or at least translucent, but in some instances, opaque supports may be useful. Useful polymeric materials for making such supports 32 include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 18431. A method of making dimensionally stable polyester films is described in *Research Disclosure*, September, 1999, item 42536.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials.

Support materials may also be treated or annealed to reduce shrinkage and promote dimensional stability.

Using the construction options, adhesive, and support choices and process choices outlined above, it is possible to make a product that is unique in its ability to: (a) eliminate chemical emissions during transport of the film over the heated roll; (b) provide more robust handling (due to better scratch resistance, peel-back resistant edge quality, debris-resistant edges); (c) allow for greater flexibility of film tint and tone through judicious choices of the tint and tone of the support 32 and complement film 40; and (d) allow addition of various functional layers otherwise incompatible with imaging layer 34.

The following examples are provided to illustrate the practice of the present invention, and are not intended to be limiting in any manner. The examples provide exemplary procedures using the adhesives and lamination materials within the scope of the present invention.

EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

AIRFLEX® 920 is a carboxylated ethylene-vinyl acetate (EVA) copolymer available from Air Products (Allentown, Pa.).

DRYVIEW® Medical Imaging Film is available from Eastman Kodak Health Imaging (Rochester, N.Y.).

DRYVIEW® Model 8700 Medical Imaging Film Processor is available from Eastman Kodak Health Imaging (Rochester, N.Y.).

ESTANE® 5703 and ESTANE® 5715 are polyester based polyurethane resins available from Noveon, Inc. (Cleveland, Ohio).

VITEL® PE 5833 is a polyester resin available from Bostik Findley (Middleton, Mass.).

PVDC is a polyvinylidene chloride based primer layer coated onto the complement film prior to orientation.

PARALOID® B-72 is an acrylic copolymer available from Rohm and Haas (Philadelphia, Pa.).

TYLAC® 68219-00 is a carboxylated styrene-butadiene copolymer latex adhesive available from Reichhold Chemicals (Durham, N.C.).

TL 4421 is a polyurethane adhesive used. C63 is a catalytic agent used in its cure. Both are available from Mace Adhesives (Dudley, Mass.).

REXAM™ 15575 is a 1.5 mil (38.1 μm) polyester support available from Loparex, Inc. (Willowbrook, Ill.).

Teijin EOK2 is a 0.4 mil (10.16 μm) polyester support from DuPont Teijin (Wilmington, Del.).

Determination of Volatile Emissions:

The amounts of toners, developers, and fatty acids emitted were determined by gas chromatography as described below. This method is referred to as the "Receptor/GC Method".

A receptor sheet of 1 mil (25.4 μm) polyethylene terephthalate (PET) coated with Cellulose Acetate CA-398-6 from Eastman Chemical (Kingsport, Tenn.) and SYLOID® 244 from Grace Davison (Baltimore, Md.) was placed over a prior art sheet of photothermographic film. The sheet was exposed with white light of sufficient intensity to achieve a Dmax of 3.0 or higher and the material was then heat-developed at 122° C. for 15 seconds using a commercial DRYVIEW® 8700 Thermal Processor. The receptor sheet was then removed and any toners, developers, or fatty acids transferred to it from the photothermographic material were extracted and analyzed by gas chromatography (GC).

Determination of Edge Peelback:

The extent of edge peelback was determined using the Edge Peelback Method" described below.

A heated processor unit from a commercial DRYVEW® 8700 Thermal Processor is used for the test. It is driven at the same speed and temperature as in the commercial units. A diverter bar is mounted in front of the processor at a gap of 10 mil (254 μm). The diverter bar is made sticky to the touch by 5 to 8 repeat applications of a "developed imaging layer"

mixture. The developed imaging layer mixture consists of solution of polyvinyl butyral resin, polyester resin, fatty acids, crosslinkers, and toners dissolved in a mixture of 2-butanone and methanol. It is designed to mimic the constitution of the developed imaging layer, but without the reduced silver.

Edge peelback of the topcoat and photothermographic layers of an unprocessed sample of photothermographic film is measured in millimeters using optical microscopy and the extent of edge initial delamination is recorded. The same film is then exposed and processed using the heated processor described above. The contact of the front edge of the film (that is, the leading edge) against the sticky diverter bar causes coatings on the front edge to peel back. The front edge is then examined again by optical microscopy, and the extent of the edge peelback is quantified. Observations of smearing of coated materials onto the film surface, relative shrinkage between the base and the complement film are also made.

Determination of Peel Strength:

The peel strength of the adhesive bond in the laminated sample was tested using an Instron Tensile Tester Model 5543 fitted with a 20 lb (9.091 kg) load cell and the procedure described in ASTM D903. The results are recorded in Newton/meters (N/m).

Determination of Film Sensitometry and Associated Definitions:

Sensitometry measurements were made on a custom built computer scanned densitometer and are believed to be comparable to measurements from commercially available densitometers. The coated and dried photothermographic materials prepared above were cut into 1.5 inch×10 inch strips (3.8 cm×25.4 cm) and exposed through a 10 cm continuous wedge with a scanning laser sensitometer incorporating an 811 nm laser diode. The total scan time for the sample was 6 seconds. The samples were developed using a heated roll processor for 15 seconds at 255° F. (124° C.).

$D_{1.2}$ refers to a portion of an exposed sample having an optical density of 1.2.

The sensitometric terms "photospeed" or "photographic speed" (also known as "sensitivity"), "absorbance," "contrast", $D_{min}$, and $D_{max}$, have conventional definitions known in the imaging arts. Particularly, Dmin is the density of the non-exposed areas after development. It is the average of eight lowest density values on the exposed side of the fiducial mark.

The photospeed of indicated samples was compared to the speed (set at "100") of a control film as described in that example. Speed-2 (SP-2) is the relative photospeed of a sample at the density value of 1.00 above Dmin. Speed-3 (SP-3) is the relative photospeed of a sample at the density value of 2.90 above Dmin.

Average Contrast-1 (AC-1) is the absolute value of the slope of the line joining the density points of 0.60 and 2.00 above Dmin.

Average Contrast-2 (AC-2) is the absolute value of the slope of the line joining the density points 1.00 and 2.40 above Dmin.

Average Contrast-3 (AC-3) is the absolute value of the slope of the line joining the density points of 2.40 and 2.90 above Dmin.

Determination of Hot-Dark Print Stability:

The stability of the image on a developed sample of photothermographic film was evaluated using a "hot-dark" print stability test. A sample of developed film was exposed to 100 foot-candles (1076 lux) of fluorescent light for 3 hours. Densities at Dmin and D1.2 were measured and recorded. The sample was then placed in a black polyethylene bag for 3 hours at 160° F. (71.1° C.). Upon removal, density measurements were repeated. The difference in density before and after storage is a measure of the stability of the developed sample upon storage under severe conditions.

Example 1

The following example demonstrates that a laminated construction can eliminate the problem of chemical emissions and edge peelback.

A lamination experiment was conducted. The solutions were coated onto a polyethylene terephthalate support and were laminated using in-line lamination equipment. Some of the samples made during this experiment are used as an illustration of the advantages provided by a laminated product. The layers comprising the laminated construction are described in TABLE 1.

In Samples 1-2, 1–3, 1-4 and 1-7, tie layer 36 was roll-coated onto pre-coated layer 34 comprising photothermographic emulsion and carrier layer (containing acutance dye, print stabilizers, shelf-life promoters, and adhesion promoters), and was then laminated in-line to polyethylene terephthalate complement film 40. In Samples 1-5 and 1-6, tie layer 36 was simultaneously coated with layer 34 comprising photothermographic emulsion and a carrier layer (containing acutance dye, print stabilizers, shelf-life promoters and adhesion promoters), using a slide coater. Adhesive layer 38 was separately roll-coated onto polyethylene terephthalate complement film 40 and then in-line laminated to the tie layer surface of the photothermographic emulsion with tie layer. The photothermographic layer in these samples was prepared substantially as described in U.S. Pat. No. 5,939,249 (Zou), incorporated herein by reference. The carrier layer was prepared substantially as described in U.S. Pat. No. 6,355,405 (Ludemann et al.), incorporated herein by reference. Materials were coated 17 inchnes (0.43 m) wide on a 53 inch (1.346 m) support. A sample of Eastman Kodak DRYVIEW® Medical Imaging Film was used as a control and is labeled Sample 1-1.

The conditions used for lamination were roll durometer (hardness of the roll) of 60, a lamination speed of 40 fpm (12.2 m/min), a lamination gap of 0, and a lamination pressure of 80 psi (551.6 kPA). Lamination temperature was varied and is shown in TABLE 2.

TABLE 1

Description of Laminated Constructions

| Sample | Support 32 | Imaging Layer 34 | Tie Layer 36 | Adhesive Layer 38 | Complement film 40 |
|---|---|---|---|---|---|
| 1-1 (Control) | 7 mil (177.8 μm) PET | Photothermographic emulsion and carrier layer | None | None | None |
| 1-2 | 4 mil (101.6 μm) PET | Photothermographic emulsion and carrier layer | ESTANE ® 5703/ VITEL ® PE5833 | none | 4 mil (101.6 μm) PET |
| 1-3 | 4 mil (101.6 μm) PET | Photothermographic emulsion and carrier layer | ESTANE ® 5703/ VITEL ® PE5833 | none | PVDC primed 4 mil (101.6 μm) PET |
| 1-4 | 4 mil (101.6 μm) PET | Photothermographic emulsion and carrier layer | ESTANE ® 5703 | none | PVDC primed 4 mil (101.6 μm) PET |
| 1-5 | 4 mil (101.6 μm) PET | Photothermographic emulsion and carrier layer | ESTANE ® 5715 | ESTANE ® 5703/ VITEL ® PE5833 | 4 mil (101.6 μm) PET |
| 1-6 | 4 mil (101.6 μm) PET | Photothermographic emulsion and carrier layer | PARALOID ® B72 | ESTANE ® 5703/ PE5833 | 4 mil (101.6 μm) PET |
| 1-7 | 7 mil (177.8 μm) PET | Photothermographic emulsion and carrier layer | ESTANE ® 5703/ VITEL ® PE5833 | none | 1 mil (25.4 μm) PET |

TABLE 2

Lamination Temperature

| Sample | Lamination Temp ° F. (° C.) |
|---|---|
| 1-1 | n/a |
| 1-2 | 220 (104.4) |
| 1-3 | 180 (82.2) |
| 1-4 | 180 (82.2) |
| 1-5 | 180 (82.2) |
| 1-6 | 210 (98.9) |
| 1-7 | 210 (98.9) |

Emissions of volatile materials from samples of photothermographic materials were determined using the Receptor/GC Method described above. The results, shown below in TABLE 3, demonstrate that no detectable amounts of toners, developers, or fatty acids were emitted from laminated constructions. Emissions were detectable from non-laminated samples.

TABLE 3

Detectability of Volatile Materials by Receptor/GC Method

| Sample | Toners $mg/m^2$ | Developers $mg/m^2$ | Total Fatty Acids $mg/m^2$ |
|---|---|---|---|
| 1-1 | Detected | Detected | Detected |
| 1-2 | None Detected | None Detected | None Detected |
| 1-3 | None Detected | None Detected | None Detected |
| 1-4 | None Detected | None Detected | None Detected |
| 1-5 | None Detected | None Detected | None Detected |
| 1-6 | None Detected | None Detected | None Detected |
| 1-7 | None Detected | None Detected | None Detected |
| 1-8 | None Detected | None Detected | None Detected |

The effect of lamination on leading edges with a Dmax of 3.0 or higher was studied using the Edge Peelback Method described above. The results, shown below in TABLE 4, demonstrate that the control sheet displays significant peel back. Also, smearing on the film surface was very noticeable. In contrast, in the experimental laminated samples the film edge is very clean. Imaging layer 34 was found to shrink back only a small amount. The edge quality observed was far superior that of the control. This improvement even more apparent at the corners of the film, a region which usually shows particularly bad edge delamination. There did not appear to be any shrinkage between the complement film 40 and support 32. Also, there was no evidence of puckering or warping due to differential shrinkage of support and complement film.

The data for edge delamination of unprocessed samples was also measured. TABLE 4 demonstrates that the quality of the edges after slitting and chopping of the laminated construction to the final film dimensions (an operation referred to as "converting") of the laminated experimental sheets is also equivalent to that seen in standard DRYVIEW® film.

TABLE 4

Effect on Leading Edge Peelback

| | Edge Peelback of Unprocessed Samples | | Edge Peelback of Processed Samples | |
|---|---|---|---|---|
| Sample | Edge 1 mm | Edge 2 mm | Leading Edge mm | Comments |
| 1-1 | 0.02 | 0.09* | 0.18 | Smearing |
| 1-2 | 0.06 | 0.07* | 0.1 | No sticking |
| 1-3 | 0.06 | 0.08* | 0.11 | No sticking |
| 1-4 | 0.05 | 0.07* | 0.09 | No sticking |
| 1-5 | 0.06 | 0.08* | 0.07 | No sticking |
| 1-6 | 0.06 | 0.07* | 0.07 | No sticking |
| 1-7 | 0.00 | 0.09* | 0.12 | Sticking to diverter bar; Imaging layer exposed |

TABLE 4-continued

| Effect on Leading Edge Peelback | | | | |
|---|---|---|---|---|
| | Edge Peelback of Unprocessed Samples | | Edge Peelback of Processed Samples | |
| Sample | Edge 1 mm | Edge 2 mm | Leading Edge mm | Comments |
| 1-7 | 0.0* | 0.08 | 0.13 | No sticking; Imaging layer exposed |

*Edge identified with (*) is the Leading Edge into the processor. The other edge is the Trailing Edge.

Peel strength of the laminated samples was determined using the test procedure described above. The results, shown below in TABLE 5, demonstrate the range of adhesion in these samples. The lowered peel strength on the samples does not appear to adversely affect delamination seen in the finished sheet edge quality of the samples.

TABLE 5

| Peel Strengths for Laminated Samples | |
|---|---|
| Sample | Peel Strength (N/m) |
| 1-1 | n/a |
| 1-2 | 115 |
| 1-3 | 539 |
| 1-4 | 256 |
| 1-5 | 16 |
| 1-6 | 12 |
| 1-7 | 246 |

Samples of each coating were exposed with a scanning laser sensitometer incorporating an 811 nm laser diode and developed as described above. The sensitometric data, shown below in TABLE 6, demonstrate that laminated samples show a slight decrease in both AC-3 and Dmax. Dmin is also slightly higher in the laminated sample relative to the control (see Sample 1-7). It should also be noted that in Samples 1-2 to 1-6, support 32 has a lower blue tint, and hence has a lower Dmin.

TABLE 6

| Initial Sensitometry for Laminated Samples | | | | | | | |
|---|---|---|---|---|---|---|---|
| | Initial Sensitometry | | | | | | |
| Sample | Dmin | Dmax | SP-2 | SP-3 | AC-1 | AC-2 | AC-3 |
| 1-1 | 0.200 | 4.09 | 100.0 | 100.0 | 5.31 | 5.83 | 3.96 |
| 1-2 | 0.148 | 3.35 | 88.4 | 57.7 | 4.81 | 4.68 | 2.05 |
| 1-3 | 0.119 | 3.63 | 78.8 | 56.4 | 4.66 | 4.14 | 3.27 |
| 1-4 | 0.109 | 3.54 | 86.4 | 76.1 | 5.52 | 5.58 | 3.16 |
| 1-5 | 0.126 | 3.38 | 96.9 | 57.7 | 4.71 | 4.52 | 1.86 |
| 1-6 | 0.121 | 3.34 | 61.2 | 36.4 | 3.82 | 3.47 | 2.70 |
| 1-7 | 0.246 | 3.89 | 82.5 | 64.8 | 4.83 | 4.71 | 2.88 |
| 1-8 | 0.114 | 3.32 | 88.4 | 61.8 | 5.19 | 5.20 | 2.12 |

Example 2

The following example demonstrates that a variety of adhesives can be used to prepare laminated photothermographic films, eliminate volatile emissions therefrom, reduce edge peelback, and achieve good edge quality at the peel strengths attained. It also demonstrates that lamination can be used to prepare a substantially curl-free product.

A lamination experiment was conducted using two different types of curing adhesives, TYCEL® 7900 with TYCEL® 7283, and NOVACOTE™ 222 with CA12. The laminated constructions prepared are described in TABLE 7.

TABLE 7

| Description of Laminated Constructions | | | | | |
|---|---|---|---|---|---|
| Sample | Support 32 | Imaging Layer 34 | Tie Layer 36 | Adhesive Layer 38 | Complement film 40 |
| 2-1 (Control) | 7 mil (177.8 μm) Blue PET | Photothermographic emulsion and carrier layer | n/a | n/a | n/a |
| 2-2 | 7 mil (177.8 μm) Blue PET | Photothermographic emulsion and carrier layer | None | TYCEL ® 7900 with TYCEL ® 7283 | 48 ga. (12.7 μm) Kolon PET |
| 2-3 | 7 mil (177.8 μm) Blue PET | Photothermographic emulsion and carrier layer | None | NOVACOTE ™ NC222 with CA12 | 48 ga. (12.7 μm) Kolon PET |
| 2-4 | 7 mil (177.8 μm) Blue PET | Photothermographic emulsion and carrier layer | None | NOVACOTE ™ NC222 with CA12 | 48 ga. (12.7 μm) Kolon PET |

A control film of Eastman Kodak DRYVIEW® Medical Imaging film was evaluated alongside the laminated product for purposes of comparison. The support used in the trials is standard DRYVIEW® blue support. Photothermographic imaging layer 34 was prepared substantially as described in U.S. Pat. No. 5,939,249 (Zou) and was coated using a slide coater. Complement film 40 was 48 gauge (12.7 μm) PET, that was corona treated to improve adhesion. Adhesive layer 38 was coated onto complement film 40 using a Rotomec 3-station gravure maker machine employing a 175 line pyramid style roll. For Sample 2-3, a smoothing bar was added to the gravure coater, contacting the coated film approximately 12 in (0.30 m) upstream from the gravure roll. The purpose of the smoothing bar was to eliminate gravure coating patterns in the adhesive coating. The support was 44.25 in (1.12 m) wide. The lamination conditions were: Roll 1 was a chrome roller with a 28 in (71.12 cm) diameter, roll 2 had a 10 in (25.4 cm) diameter with a roll durometer of 90, lamination speed was 541 fpm (165 m/min), lamination pressure was 80 psi (551.6 kPa), and the wrap angle was 45–60°. Substantially curl-free laminated samples were obtained.

Emissions of volatile materials from samples of photothermographic materials were determined using the Receptor/GC Method described above. The results, shown below in TABLE 8, demonstrate that no detectable amounts of toners, developers, or fatty acids were emitted from laminated constructions. Emissions were detectable from non-laminated samples.

TABLE 8

Detectability of Volatile Materials by Receptor/GC Method

| Sample | Toners mg/m$^2$ | Developers mg/m$^2$ | Total Fatty Acids mg/m$^2$ |
|---|---|---|---|
| 2-1 | Detectable | Detectable | Detectable |
| 2-2 | None Detected | None Detected | None Detected |
| 2-3 | None Detected | None Detected | None Detected |
| 2-4 | None Detected | None Detected | None Detected |

The effect of lamination on leading edges with a Dmax of 3.0 or higher was studied using the Edge Peelback Method described above. The results, shown below in TABLE 9, demonstrate the advantages of lamination in preventing edge peelback and smearing. However, since complement film 40 shrinks relative to support 32, the advantages are less apparent than those of Example 1.

TABLE 9

Effect on Leading Edge Peelback

| | Edge Peelback of Unprocessed Samples | | Edge Peelback of Processed | |
|---|---|---|---|---|
| Sample | Edge 1 (mm) | Edge 2 (mm) | Samples mm | Comments |
| 2-1 | 0** | 0.1* | 0.25 | Smearing; Sticking to diverter bar |
| 2-2 | 0.14** | 0.14* | 0.12 | Smearing; Shrinkage of complement film |

TABLE 9-continued

Effect on Leading Edge Peelback

| | Edge Peelback of Unprocessed Samples | | Edge Peelback of Processed | |
|---|---|---|---|---|
| Sample | Edge 1 (mm) | Edge 2 (mm) | Samples mm | Comments |
| 2-2 | 0.12* | 0.14** | | Little smearing; Shrinkage of complement film |
| 2-3 | 0.14** | 0.145* | 0.12 | Smearing; Shrinkage of complement film |
| 2-3 | 0.14* | 0.15** | 0.12 | Little smearing; Shrinkage of complement film |

*Edge identified with (*) is the Leading Edge into the processor. The other edge is the Trailing Edge.

Peel strength of the laminated samples was determined using the test procedure described above. The results, shown below in TABLE 10, demonstrate adhesion was so strong that peeling could not be initiated in the samples after processing. Thus, no post-processing peel strengths were measured. Under the lamination conditions used in preparing these samples, the samples were substantially curl-free both before and after processing.

TABLE 10

Peel Strength of Laminated Samples

| Sample | Peel Strength of Unprocessed Samples (N/m) | Peel Strength of Processed Samples (N/m) |
|---|---|---|
| 2-1 | n/a | n/a |
| 2-2 | 121 | Could not peel apart |
| 2-3 | 84.5 | Could not peel apart |
| 2-4 | 79 | Could not peel apart |

Example 3

This example demonstrates the use of pressure-sensitive adhesive (PSA)-based adhesives with release liners and low-heat activated adhesives (without liners) in this invention. Improvements in print stability as well as in scratch resistance are also shown.

A number of commercial films were evaluated as complement films and laminated to imaging layer 34 coated onto a 7 mil (177.8 μm) support. Acutance dye, print stabilizers, shelf life promoters, and adhesion promoters were present in the carrier layer. The photothermographic imaging layer was prepared substantially as described in U.S. Pat. No. 5,939,249 (Zou). The carrier layer was prepared substantially as described in U.S. Pat. No. 6,355,405 (Ludemann et al.). The effect on sensitometry, and other properties was also evaluated. Lamination was carried out using a Hunt-Seal Model 410 Laminator, at a temperature of 180° F. (82.2° C.), a pressure of 80 psi (551.6 kPa), a speed of 5 fpm (1.5 m/min) and a roll gap of −1/16 in (−2.6 mm). The list of samples is presented in TABLE 11.

TABLE 11

| Commercial Films Tested as Complement Films | |
|---|---|
| Sample | Complement Film Name |
| 3-1-a | Control—no complement film |
| 3-2 | FLEXcon—FLEX-Vu OM 100 Clear—V-29/150 Poly H-9 S |
| 3-3 | FLEXcon—FLEXmark OM 100 Clear—V-95/150 Poly H-9 |
| 3-4 | FLEXcon—CLASSICS PLUS ® SELECT ™ 10092SL |
| 3-5 | FLEXcon—FLEX-Vu ® OM-100-clear—L-29/150 Poly H-9 S |
| 3-6 | FLEXcon—CLASSICS PLUS ® |
| 3-7 | FLEXcon—FLEX-Vu OM Clear 100—V-29/150 Poly H-9 S |
| 3-8 | FLEXcon—FLEXmark OM 050 Clear |
| 3-9 | USI—Digiseal w/UVI Glossy |
| 3-10 | Kodak—P/S UV Plus Gloss |

Samples of each coating were exposed with a scanning laser sensitometer incorporating an 811 nm laser diode and developed as described above. The initial sensitometry for these samples is presented in TABLE 12. The Dmin of the laminated samples is slightly increased, and the Dmax, AC-3 and SP-3 are lower as compared to the control.

TABLE 12

| Initial Sensitometry with Commercial Films Used as Complement Films | | | | | | | |
|---|---|---|---|---|---|---|---|
| | Initial Sensitometry | | | | | | |
| Sample | Dmin | Dmax | SP-2 | SP-3 | AC-1 | AC-2 | AC-3 |
| 3-1-a | 0.208 | 3.877 | 100.0 | 100.0 | | 6.54 | 2.789 |
| 3-2 | 0.209 | 3.54 | 83.4 | 48.9 | 4.09 | 4.34 | 1.61 |
| 3-3 | 0.213 | 3.61 | 102.6 | 61.5 | 4.92 | 4.47 | 1.65 |
| 3-4 | 0.216 | 3.53 | 95.7 | 53.6 | 4.80 | 4.23 | 1.60 |
| 3-5 | 0.215 | 3.57 | 95.7 | 53.6 | 4.64 | 4.15 | 1.63 |
| 3-6 | 0.217 | 3.63 | 100.2 | 65.9 | 5.07 | 4.57 | 1.85 |
| 3-7 | 0.217 | 3.60 | 98.0 | 51.2 | 4.91 | 3.99 | 1.70 |
| 3-8 | 0.218 | 3.49 | 93.5 | 51.2 | 4.64 | 4.01 | 1.65 |
| 3-9 | 0.212 | 3.48 | 76.0 | 38.8 | 3.25 | 3.06 | 2.16 |
| 3-10 | 0.219 | 3.59 | 89.3 | 57.4 | 4.81 | 4.05 | 2.15 |

The results, shown below in TABLE 13, demonstrate a significant advantage seen in the hot-dark print stability of the laminated samples relative to the control.

TABLE 13

| Hot-Dark Print Stability Using Commercial Films | | |
|---|---|---|
| | Hot-Dark Print Stability | |
| Sample | ΔD Dmin | Δ $D_{1.2}$ |
| 3-1-a | 0.1381 | 1.958 |
| 3-2 | 0.0431 | 0.274 |
| 3-3 | 0.0507 | 0.202 |
| 3-4 | 0.0613 | 0.264 |
| 3-5 | 0.0521 | 0.305 |
| 3-6 | 0.0605 | 0.235 |
| 3-7 | 0.0476 | 0.227 |
| 3-8 | 0.0487 | 0.255 |
| 3-9 | 0.0707 | 0.314 |
| 3-10 | 0.0474 | −0.643 |

Peel strength of samples 3-1 to 3-2 and 3-4 to 3-10 was measured using the procedure described above. The results, shown below in TABLE 14 demonstrate that these commercial complement films give peel strengths that are improved over those seen in Examples 1 and 2. In most of these samples, failure appeared to be between adhesive layer 38 and photothermographic imaging layer 34.

TABLE 14

| Peel Strengths for Laminated Samples | |
|---|---|
| Sample | Unprocessed Peel Strength - (N/m) |
| 3-1-a | n/a |
| 3-2 | 624 |
| 3-4 | 523 |
| 3-5 | 459 |
| 3-6 | 409 |
| 3-7 | 573 |
| 3-8 | 383 |
| 3-9 | 442 |
| 3-10 | 547 |

Samples 3-1-b, 3-1-c, 3-2, 3–6, 3-9, and 3-10 were tested for susceptibility to scratching. Control samples 3-1-b and 3-1-c had the identical topcoat as sample 3-1-a but slightly different photothermographic coatings. Samples were conditioned for 24 hours at 73° F. (22.8° C.)/50% RH before testing. After conditioning, each sample was scratched with a NanoTest 550 scratching device, (Micro Materials, Ltd., Wrexham, United Kingdom) using a constant load of 5 mN and a 60-degree (3 μm radius) diamond stylus. Scratch severity was determined by measuring scratch depth using Scanning Probe Microscopy. A series of three scratches were made on each coating. The results shown below, in TABLE 15 demonstrate that lamination provides coatings with improved scratch resistance.

TABLE 15

| Commercial Films Tested as Complement Films | |
|---|---|
| Sample | Scratch Depth - μm |
| 3-1-b | 0.36 |
| 3-1-c | 0.49 |
| 3-2 | 0.14 |
| 3-6 | 0.11 |
| 3-9 | 0.14 |
| 3-10 | 0.20 |

Example 4

This example demonstrates that lamination can be carried out by coating the adhesive directly onto the photothermographic emulsion layer and laminating to a complement film. Alternately the adhesive can be coated directly onto the complement film and laminated to a photothemographic emulsion. This example also demonstrates the use of a water-soluble adhesive system.

A dispersion of TYLAC® 68219-00 was diluted to 20% solids using distilled water. In Samples 4-1 to 4-3 and 4-5 to 4-8 the adhesive was coated onto the complement film. In Sample 4-4 the adhesive was coated onto the photothermographic emulsion layer.

The coating weight of the adhesive was 350 to 380 mg/ft$^2$ (3.767 to 4.090 g/m$^2$), when coated as layer 38 on the complement film. The coating weight of the adhesive was 250 mg/ft$^2$ (2.691 g/m$^2$) when coated on precoated silver as a tie layer 36. Lamination was carried out at 24"/min (0.61 m/min), at a roll temperature of 180° F. (82.2° C.), and a lamination gap of 0 in.

In samples 4-5 to 4-8, coatings of TYLAC® 68219-00 as adhesive layer 38, were coated onto a 4 mil (101.6 μm) polyethylene terephthalate support or onto a 1.5 mil (38.1 μm) REXAM™ 15575 support at a coverage of 380 mg/ft (4.090 g/m$^2$). In samples 4-5 and 4-7 adhesive-coated complement films were laminated to the photothermographic emulsion layer. In samples 4-6 and 4-8, adhesive-coated complement films were laminated to the protective topcoat layer.

The laminated constructions are shown below in TABLE 16. The carrier layer was prepared substantially as described in U.S. Pat. No. 6,355,405 (Ludemann et al.). The photothermographic imaging layer and protective topcoat layers were prepared substantially as described in U.S. Pat. No. 5,939,249 (Zou).

Samples of each coating were exposed with a scanning laser sensitometer incorporating an 811 nm laser diode and developed as described above. The results shown below in TABLE 18 demonstrate, that lower photosensitivity is seen when the TYLAC® 68219 complement film is laminated to the topcoat of a photothermographic material containing both photothermographic emulsion and topcoat layers. When laminated directly to the emulsion layer greater photosensitivity is seen. The control film sample in these tables was is Eastman Kodak DRYVIEW® Medical Imaging Film.

Samples of each coating were stored for 7 days at 50° C./50% RH then imaged and process as described above. The sensitometric properties of these samples is shown below in TABLE 19.

TABLE 16

Description of Laminated Constructions

| Sample | Support 32 | Imaging Layer 34 | Tie Layer 36 | Adhesive Layer 38 | Complement film 40 |
|---|---|---|---|---|---|
| 4-1 | 7 mil (177.8 μm) PET | Carrier layer/ Photothermographic Emulsion | None | TYLAC ® 68219-00 | 4 mil (101.6 μm) subbed ESTAR |
| 4-2 | 7 mil (177.8 μm) PET | Carrier layer/ Photothermographic Emulsion | None | TYLAC ® 68219-00 | REXAM ™ 15575 |
| 4-3 | 7 mil (177.8 μm) PET | Carrier layer/ Photothermographic Emulsion | None | TYLAC ® 68219-00 | REXAM ™ 15575 |
| 4-4 | 7 mil (177.8 μm) PET | Carrier layer/ Photothermographic Emulsion | TYLAC ® 68219-00 | None | Teijin EOK2 |
| 4-5 | 7 mil (177.8 μm) PET | Carrier layer/ Photothermographic Emulsion | None | TYLAC ® 68219-00 | 4 mil (101.6 μm) PET |
| 4-6 | 7 mil (177.8 μm) PET | Carrier layer/ Photothermographic Emulsion/ Protective Topcoat | None | TYLAC ® 68219-00 | 4 mil (101.6 μm) PET |
| 4-7 | 7 mil (177.8 μm) PET | Carrier layer/ Photothermographic Emulsion | None | TYLAC ® 68219-00 | REXAM ™ 15575 |
| 4-8 | 7 mil (177.8 μm) PET | Carrier layer/ Photothermographic Emulsion/ Protective Topcoat | None | TYLAC ® 68219-00 | REXAM ™ 15575 |

The peel strength of samples 4-1 to 4-4 was measured as described above. The results, shown below in TABLE 17 demonstrate that both methods (coating adhesive as tie layer 36 or as adhesive layer 38) gave good adhesion

TABLE 17

Peel Strengths for Laminated Samples

| Sample | Peel Strength (N/m) | Failure Interface |
|---|---|---|
| 4-1 | 476 | Adhesive/Emulsion |
| 4-2 | 373 | Adhesive/Complement film |
| 4-3 | 329 | Adhesive/Complement film |
| 4-4 | 292 | Complement film failure |

TABLE 18

Initial Sensitometric Properties.

| | Initial Sensitometry | | | | | | |
|---|---|---|---|---|---|---|---|
| Sample | Dmin | Dmax | SP-2 | SP-3 | AC-1 | AC-2 | AC-3 |
| Control | 0.197 | 3.72 | 100.0 | 100.0 | 4.54 | 5.04 | 3.70 |
| 4-5 | 0.559 | 3.02 | 183.2 | **** | 2.91 | **** | **** |
| 4-6 | 0.230 | 3.77 | 121.0 | 106.8 | 4.47 | 4.64 | 2.76 |
| 4-7 | 0.229 | 3.26 | 171.0 | 53.5 | 3.40 | 3.07 | 1.03 |
| 4-8 | 0.212 | 3.64 | 107.9 | 70.6 | 3.20 | 3.16 | 2.94 |

TABLE 19

Sensitometric Properties of Aged Samples.

| | 3 Day Desk Top | | | Sensitometry of Aged Samples | | | |
|---|---|---|---|---|---|---|---|
| Sample | Δ $Dmin_B$ 1 | Δ $Dmin_B$ 2 | Δ $Dmin_B$ 3 | Δ Dmin | Δ SP-2 | Δ AC-1 | Δa Dmax |
| Control | 0.038 | 0.019 | 0.038 | 0.007 | −27.6 | −0.989 | −0.170 |
| 4-5 | 0.074 | 0.018 | 0.074 | −0.243 | 27.7 | 0.759 | 0.434 |
| 4-6 | 0.038 | 0.016 | 0.038 | 0.024 | 25.5 | −0.787 | −0.101 |
| 4-7 | 0.039 | 0.012 | 0.039 | 0.044 | −5.4 | −0.250 | 0.237 |
| 4-8 | 0.034 | 0.021 | 0.037 | 0.025 | 16.0 | −0.348 | −0.064 |

Δ $Dmin_B$ 1 is the increase in $Dmin_B$ due to an exposure of 100 foot-candles (1076 lux).
Δ $Dmin_B$ 2 is the increase in $Dmin_B$ due to an exposure of 1 foot-candle (10.76 lux).
Δ $Dmin_B$ 3 is the maximum increase in $Dmin_B$ observed in the film.

Example 5

This example demonstrates the use of a water-based carboxylated ethylene vinyl acetate (EVA) copolymer emulsion as a laminating adhesive.

This example also demonstrates that lamination can be carried out either by coating the adhesive directly onto either the photothermographic emulsion layer of the film or onto topcoat layer of a photothermographic layer/topcoat layer construction and then laminating to a complement film (Samples 5-2 and 5-3). Samples 5-4 and 5-5 further demonstrate that the adhesive can also be coated directly onto the complement film and laminated to either the photothermographic emulsion layer of the film or the topcoat layer of a photothermographic layer/topcoat layer construction. Sample 5-1 is a control construction that is not laminated.

AIRFLEX® 920 was used as the laminating adhesive. It was used at 43% solids in water. The adhesive coating weight used was 343 mg/ft$^2$ (3.692 g/m$^2$). Lamination was carried out using a Hunt-Seal Model 410 Laminator. The lamination gap was −1/16 in (−0.159 cm), the lamination speed was 5 fpm (1.5 m/min), the pressure was 80 psi (551.6 kPa), and the temperature was 180° F. (82.2° C.).

A list of constructions used in this example shown below in TABLE 20. The carrier layer in Samples 5-3 and 5-5 was prepared containing acutance dye, print stabilizers, shelf life promoters and adhesion promoters. The carrier layer solutions were prepared substantially as described in U.S. Pat. No. 6,355,405 (Ludemann et al.). The photothermographic imaging layer and protective topcoat layers were prepared substantially as described in U.S. Pat. No. 5,939,249 (Zou).

TABLE 20

Description of Laminated Constructions

| Sample | Support 32 | Imaging Layer 34 | Tie Layer 36 | Adhesive Layer 38 | Complement film 40 |
|---|---|---|---|---|---|
| 5-1 | 7 mil (177.8 μm) blue PET | Carrier layer/ Photothermographic Emulsion/Topcoat | None | None | None |
| 5-2 | 7 mil (177.8 μm) blue PET | Carrier layer/ Photothermographic Emulsion/Topcoat | AIRFLEX ® 920 | None | 3 mil (76.2 μm) clear PET |
| 5-3 | 7 mil (177.8 μm) blue PET | Carrier layer/ Photothermographic Emulsion | AIRFLEX ® 920 | None | 3 mil (76.2 μm) clear PET |
| 5-4 | 7 mil (177.8 μm) blue PET | Carrier layer/ Photothermographic Emulsion/Topcoat | None | AIRFLEX ® 920 | 3 mil (76.2 μm) clear PET |
| 5-5 | 7 mil (177.8 μm) blue PET | Carrier layer/ Photothermographic Emulsion | None | AIRFLEX ® 920 | 3 mil (76.2 μm) clear PET |

Peel strengths of samples 5-2 to 5-5 were measured using the procedure described above. The results, shown below in TABLE 21 demonstrate that AIRFLEX® 920 gives better adhesion to the emulsion layer, but that all of the above described configurations give acceptable adhesive.

TABLE 21

Peel Strengths for Laminated Samples

| Sample | Peel Strength (N/m) |
|---|---|
| 5-2 | 303 |
| 5-3 | 637 |
| 5-4 | 248 |
| 5-5 | 691 |

The sensitometry of the constructions were also evaluated. Samples of each coating were exposed with a scanning laser sensitometer incorporating an 811 nm laser diode and developed as described above. The initial sensitometry, shown below in TABLE 22, demonstrates that when the adhesive is contacted to the photothermographic emulsion layer, an increase in minimum density and decrease in contrast is seen. Initial sensitometry is improved when the adhesive was coated onto a construction employing a top-coat over the photothermographic emulsion layer.

TABLE 22

Initial Sensitometry of Configurations Example 4

| | Initial Sensitometry: | | | | | | |
|---|---|---|---|---|---|---|---|
| Sample | Dmin | Dmax | SP-2 | SP-3 | AC-1 | AC-2 | AC-3 |
| 5-1 | 0.214 | 3.79 | 100.0 | 100.0 | 4.76 | 5.09 | 3.83 |
| 5-2 | 0.234 | 3.80 | 112.2 | 95.5 | 4.44 | 4.56 | 2.92 |
| 5-3 | 0.291 | 3.67 | 177.8 | 109.7 | 4.75 | 3.97 | 1.89 |
| 5-4 | 0.233 | 3.79 | 109.7 | 97.7 | 4.69 | 4.76 | 3.01 |
| 5-5 | 0.255 | 3.59 | 182.0 | 100.0 | 4.35 | 3.89 | 1.62 |

Example 6

This example demonstrates the addition of a wax to AIRFLEX® 920 adhesive in order to enable off-line lamination by preventing blocking of adhesive layer 38 to the opposite side of complement film 40, when wound up after coating. The wax used in this case is ULTRALUBE® E-390, which is a blend of paraffin and polyethylene waxes supplied by Ashland Chemical Drew Industrial Division (Boonton, N.J.). ULTRALUBE® E-390 can be added at anywhere from 5–25% of the adhesive and yield acceptable results (Samples 6-5 to 6-9). The optimum amount of ULTRALUBE® E-390 in AIRFLEX® 920 is 14 wt % ULTRALUBE® E-390 to the weight of solids of the AIRFLEX® 920 adhesive. The resulting adhesive with wax can be coated on the complement film 40 and laminated to imaging layer 34, see Samples 6-4 and 6-5. Alternatively, the resulting adhesive can be coated onto the imaging layer 34 and laminated with the complement film 40, see Samples 6-2 and 6-3. Sample 6-1 is a laminated control with AIRFLEX® 920 used as the adhesive, as described in Example 5.

In Example 6, AIRFLEX® 920 was used at 40% solids in water and coated at a thickness of approximately 400 mg/ft$^2$. Lamination was carried out using a Hunt-Seal Model 410 Laminator. The lamination gap was −1/16 in (−0.159 cm), the lamination speed was 5 fpm (1.5 m/min), the pressure was 80 psi (551.6 kPa), and the temperature was 180° F. (82.2° C.).

TABLE 23 below describes the constructions and the percent wax used in each sample in this example. The carrier layer was prepared substantially as described in U.S. Pat. No. 6,355,405 (Ludemann et al.). The photothermographic emulsion layer and protective topcoat layers were prepared substantially as described in U.S. Pat. No. 5,939,249 (Zou).

TABLE 23

Description of Laminated Constructions

| Sample | Support 32 | Imaging Layer 34 | Tie Layer 36 | Adhesive Layer 38 | Complement film 40 |
|---|---|---|---|---|---|
| 6-1 | 7 mil (177.8 μm) blue PET | Carrier Layer/ Photothermographic Emulsion/Protective Topcoat | None | AIRFLEX ® 920 | 3 mil (76.2 μm) clear PET |
| 6-2 | 7 mil (177.8 μm) blue PET | Carrier Layer/ Photothermographic Emulsion | AIRFLEX ® 920 with 14% ULTRALUBE ® E-390 | none | 3 mil (76.2 μm) clear PET |
| 6-3 | 7 mil (177.8 μm) blue PET | Carrier Layer/ Photothermographic Emulsion/Protective Topcoat | AIRFLEX ® 920 with 14% ULTRALUBE ® E-390 | None | 3 mil (76.2 μm) clear PET |
| 6-4 | 7 mil (177.8 μm) blue PET | Carrier Layer/ Photothermographic Emulsion | None | AIRFLEX ® 920 with 14% ULTRALUBE ® E-390 | 3 mil (76.2 μm) clear PET |
| 6-5 | 7 mil (177.8 μm) blue PET | Carrier Layer/ Photothermographic Emulsion/Protective Topcoat | None | AIRFLEX ® 920 with 14% ULTRALUBE ® E-390 | 3 mil (76.2 μm) clear PET |
| 6-6 | 7 mil (177.8 μm) blue PET | Carrier Layer/ Photothermographic Emulsion/Protective Topcoat | None | AIRFLEX ® 920 with 5% ULTRALUBE ® E-390 | 3 mil (76.2 μm) clear PET |
| 6-7 | 7 mil (177.8 μm) blue PET | Carrier Layer/ Photothermographic Emulsion/Protective Topcoat | None | AIRFLEX ® 920 with 10% ULTRALUBE ® E-390 | 3 mil (76.2 μm) clear PET |
| 6-8 | 7 mil (177.8 μm) blue PET | Carrier Layer/ Photothermographic Emulsion/Protective Topcoat | None | AIRFLEX ® 920 with 20% ULTRALUBE ® E-390 | 3 mil (76.2 μm) clear PET |
| 6-9 | 7 mil (177.8 μm) blue PET | Carrier Layer/ Photothermographic Emulsion/Protective Topcoat | None | AIRFLEX ® 920 with 25% ULTRALUBE ® E-390 | 3 mil (76.2 μm) clear PET |

All of the complement films made with ULTRALUBE® E-390 wax were coated and then rolled up with the adhesive against the polyethylene terephthalate. The adhesive released easily from the polyethylene terephthalate with no adhesive transfer to the polyethylene terephthalate when unrolled for lamination. As the level of wax in the AIRFLEX® 920 was increased, the release from the polyethylene terephthalate became easier. These complement films were then laminated as described in TABLE 1.

Peel strengths for Samples 6-1 to 6-9 were measured as described above. The results, shown below in TABLE 24 demonstrate that adhesive with wax had better adhesion to the topcoat layer than to the photothermographic imaging layer. Addition of wax to the adhesive did not adversely affect the peel strength of the complement film to the substrate in the range of wax levels investigated. In some cases, adhesion actually improved.

TABLE 24

Peel Strength for Laminated Samples

| Sample | Peel Strength (N/m) |
|---|---|
| 6-1 | 155 |
| 6-2 | 95 |
| 6-3 | 146 |
| 6-4 | 79 |
| 6-5 | 156 |
| 6-6 | 169 |
| 6-7 | 262 |
| 6-8 | 296 |
| 6-9 | 226 |

Samples of each coating were exposed with a scanning laser sensitometer incorporating an 811 nm laser diode and developed as described above. The sensitometric properties of all of the constructions listed in TABLE 23 were measured using the procedures described above. No additional effect was seen on sensitometry beyond that seen with the AIRFLEX® 920 adhesive without the wax (as described in Example 5).

The wax used has to have a melting temperature below that of the temperature in the laminator nip or else wax particulates will be present in the final coating. The ULTRALUBE® E-390 wax has a melting point of approximately 180° F. (82.2° C.). Since the actual interface temperature reached as the constructions are laminated is only 150° F. (65.5° C.), wax particulates were observed in the coating. If a wax had been used with a lower melting point these particulates should not have been present in the final laminated coating.

Thus, this example shows that adding a wax to an adhesive can enable off-line lamination. When the adhesive is formulated with an added wax, the adhesive layer 38 coated onto complement film 40 can be rolled up on itself and later easily released, without blocking. This can be accomplished without any adverse effects on the peel strength or sensitometry of the final laminated product. This can also be accomplished in a variety of different lamination constructions and over a wide range of wax added.

Example 7

This example demonstrates the use of an organic solvent-soluble two-part adhesive system using TL 4421, with C63 used as the catalytic agent. A solution of TL4421/C63 in a 50/50 (w/w) 2-propanol/ethyl acetate solvent system was prepared at 30% solids. The adhesive was coated as adhesive layer 38 onto a 4 mil (101.6 μm) raw polyethylene terephthalate complement film (Sample 7-1) and onto a 1.5 mil (38.1 μm) REXAM™ 15575 complement film (Sample 7-2). The coating weight of the adhesive in these samples was 343 mg/ft$^2$ (3.692 g/m$^2$). The adhesive coated complement film was then laminated to various photothermographic materials. In samples 7-3 and 7-4 another set of samples was similarly prepared. The adhesive for these samples was coated onto a 1.5 mil (38.1 μm) REXAM™ 15575 complement film and then laminated to photothermographic layer 34. These different constructions are presented in TABLE 25.

Lamination was carried out at 5 ft (1.524 m)/min and at a roll temperature of 150° F. (65.5° C.) to give the laminated photothermographic materials.

TABLE 25

Configurations used in Example 7.

| Sample | Support 32 | Imaging Layer 34 | Tie Layer 36 | Adhesive Layer 38 | Complement film 40 |
|---|---|---|---|---|---|
| 7-1 | 7 mil (177.8 μm) PET | Carrier Layer/ Photothermographic Emulsion/Protective Topcoat | — | TL4421/C63 | 4 mil (101.6 μm) PET, 6RF1-040 |
| 7-2 | 7 mil (177.8 μm) PET | Carrier Layer/ Photothermographic Emulsion | — | TL4421/C63 | 4 mil (101.6 μm) PET, 6RF1-040 |
| 7-3 | 7 mil (177.8 μm) PET | Carrier Layer/ Photothermographic Emulsion | — | TL4421/C63 | REXAM 15575 |
| 7-4 | 7 mil (177.8 μm) PET | Carrier Layer/ Photothermographic Emulsion/Protective Topcoat | — | TL4421/C63 | REXAM 15575 |

The peel strength of Samples 7-1 and 7-2 was measured using the procedure described above. The results, shown below in TABLE 26, demonstrate that adequate bond strength is achieved using this adhesive.

TABLE 26

| Peel Strength of Laminated Samples | |
|---|---|
| Sample | Peel Strength (N/m) |
| 7-1 | 702.6 |
| 7-2 | 1717.6 |

Samples of each coating were exposed with a scanning laser sensitometer incorporating an 811 nm laser diode and developed as described above. The sensitometric properties of Samples 7-3 and 7-4, shown below in TABLE 27 demonstrate that no detrimental effects on sensitometry occurred. Only a slight decrease in contrast was found.

TABLE 27

| Sensitometric Properties | | | | | | | |
|---|---|---|---|---|---|---|---|
| | Initial Sensitometry | | | | | | |
| Sample | Dmin | Dmax | SP-2 | SP-3 | AC-1 | AC-2 | AC-3 |
| Control | 0.197 | 3.75 | 100.0 | 100.0 | 4.28 | 4.79 | 3.74 |
| 7-3 | 0.23 | 3.62 | 162.2 | 89.2 | 3.77 | 3.27 | 1.91 |
| 7-4 | 0.22 | 3.67 | 93.3 | 72.5 | 3.40 | 3.57 | 3.37 |

Example 8

This example demonstrates two methods of preparing laminated photothermographic materials: (1) coating adhesive 38 onto photothermographic layer 34 and then laminating to complement film 40, and (2) coating adhesive 38 onto complement film 40 and then laminating the adhesive coated complement film to photothermographic layer 34.

In Samples 8-2 and 8-3, two different adhesives were coated onto photothermographic layer 34. These adhesive coatings were then laminated to 3 mil (76.2 μm) polyethylene terephthalate complement film 40. In Samples 8-4 and 8-5, the adhesives (38) were first coated onto 3 mil (76.2 μm) polyethylene terephthalate complement film 40 and the adhesive/complement film combination (layers 38 plus 40) was then laminated onto the photothermographic material. All laminations were carried out at 5 ft (1.524 m)/minute, with a lamination roll temperature of 180° F. (82.2° C.), a roll pressure of 80 psi (551.6 kPa), and a lamination gap of −1/16 in (−2.5 mm). Sample 8-1 served as a control. The configuration of samples 8-1 to 8-5 is shown below in TABLE 28.

TABLE 28

| Samples Using Various Coating Configurations for Lamination | | | | | |
|---|---|---|---|---|---|
| Sample | Support 32 | Imaging Layer 34 | Tie Layer 36 | Adhesive Layer 38 | Complement Film 40 |
| 8-1 | 7 mil (177.8 μm) blue PET with antihalation layer | Carrier Layer/ Photothermographic Emulsion/Protective Topcoat | None | None | None |
| 8-2 | 7 mil (177.8 μm) blue base PET | Carrier Layer/ Photothermographic Emulsion | ADCOTE ® 548H | None | 3 mil (76.2 μm) PET |
| 8-3 | 7 mil (177.8 μm) blue base PET | Carrier Layer/ Photothermographic Emulsion | ADCOTE ® 102E | None | 3 mil (76.2 μm) PET |
| 8-4 | 7 mil (177.8 μm) blue base PET | Carrier Layer/ Photothermographic Emulsion | None | ADCOTE ® 548H | 3 mil (76.2 μm) PET |
| 8-5 | 7 mil (177.8 μm) blue base PET | Carrier Layer/ Photothermographic Emulsion | None | ADCOTE ® 102E | 3 mil (76.2 μm) PET |

The peel strength of the samples was measured as described above. The results, shown below in TABLE 29, demonstrate that adhesion of the laminates appears to be dependent on the lamination method used. However all samples gave acceptable adhesion.

TABLE 29

| Peel Strength of Laminated Samples | |
|---|---|
| Sample | Peel Strength (N/m) |
| 8-1 | n/a |
| 8-2 | 449 |
| 8-3 | 564 |
| 8-4 | 1040 |
| 8-5 | 491 |

Example 9

This example demonstrates the use of an ink jet receptive layer 44 on top of complement film 40 to enable color printing on the resulting laminated photothermographic film 30. Such application is of great value in printing images from medical modalities such as Doppler Ultrasound, Nuclear Medicine, and Positron Emission Tomography.

3M Brand Transparency Film (CG 3460) was coated with AIRFLEX® 920 at 40% solids at a wet thickness of approximately 1 mil (25.4 μm). This resulting complement film was then laminated to an 8"×10" (20.32 cm×25.4 cm) sheet of exposed and processed photothermographic film. This construction was run through an Epson Stylus Color 800 ink-jet printer and color images were printed on an ink-jet receptor layer (functional layer 44) of the film 30.

This experiment could alternatively have been accomplished by laminating the 3M Brand Transparency Film to the photothermographic film before exposure and processing, and subsequently printing the color image onto the film.

From the foregoing, it will be seen that this invention is one well adapted to obtain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

Parts List

30 laminated photothermographic film
32 support
34 photothermographic imaging layer
36 tie layer
38 adhesive layer
40 complement film or web
42 backside coating
44 functional layers
50 roll
52 pre-coated support
54 extruding station
60 roll
62 pre-coated support
63 adhesive
64 applicator
66 nip rollers

What is claimed is:

1. A photothermographic film comprising (a) a support, (b) a photothermographic imaging layer coated on me support, and (c) a complement film comprising a precoated or uncoated support that is laminated to the photothermographic imaging layer and generally confining the photothermographic imaging layer between the support end the complement film, the complement film being preformed and then laminated to the photothermographic imaging layer prior to exposure of the photothermographic imaging layer, the complement film retaining any volatile materials present in the photothermographic imaging layer generated when thermal energy is applied thereto to develop a latent image exposed on the photothermographic imaging layer wherein:

the complement film is polyethylene terephtalate or polyethylene naphthalahte or polycarbonate.

2. A photothermographic film as recited in claim 1 further comprising:

an adhesive layer bonding the complement film to the photothermographic imaging layer.

3. A photothermographic film as recited in claim 1 further comprising:

a tie layer coated on the photothermographic imaging layer, the tie layer interfacing with the complement film.

4. A photothermographic film as recited in claim 3 further comprising:

an adhesive layer bonding the complement film to the tie layer.

5. A photothermographic film as recited in claim 1 further comprising:

at least one backside coating applied to the support.

6. A photothermographic film as recited in claim 5 wherein:

the at least one backside coating includes an antihalation dye.

7. A photothermographic film as recited in claim 5 wherein:

the at least one backside coating includes a transport matte agent.

8. A photothermographic film as recited in claim 5 wherein:

the at least one backside coating includes an anti-static agent.

9. A photothermographic film as recited in claim 3 wherein:

the tie layer is coated simultaneously with the photothermographic imaging layer on the support.

10. A photothermographic film as recited in claim 3 wherein:

the tie layer is coated separately from the photothermographic imaging layer.

11. A photothermographic film as recited in claim 1 wherein:

the photothermographic imaging layer is coated onto the support with a carrier layer.

12. A photothermographic film as recited in claim 1 wherein:

the support is a polyester.

13. A photothermographic film as recited in claim 12 wherein:

the support is polyethylene terephthalate or polyethylene naphthalahte.

14. A phorothennographic film as recited in claim 1 wherein:

the support has a thickness of about 7 mil (177.$\mu$m).

15. A photothermographic film as recited in claim 1 wherein:

the photothermographic imaging layer is a composite multilayer coating.

16. A photothermographic film as recited in claim 1 further comprising at least one coating layer applied to the complement film on a side thereof opposite the photothermographic imaging layer.

17. A photothermographic film as recited in claim 16 wherein;

the at least one coating layer is a gloss control layer, a scratch resistant layer, an image receptor layer, a dye receptor layer, an ink receptive layer, a release layer, or a combination two or more thereof.

18. A method for producing a developed image on a photothermographic film comprising the stops of:

(a) coating a photothermographic imaging layer onto a moving support, (b) forming a complement film comprising a precoated or uncoated support;

(a) laminating the complement film to the photothermographic imaging layer to place the photothermographic imaging layer between the support and the complement film, the complement film being applied to the photothermographic graphic imaging layer prior to imaging of the photothermographic imaging layer to form a photothermographic mm;

(d) exposing the photothermographic film to generate a desired latent image thereon, (e) applying thermal energy to the photothermographic film to develop the latent image; and (f) retaining any volatile materials present in the photothermographic imaging layer generated during the step of applying thermal energy between the support web and the complement film.

19. A method for making a photothermographic film comprising to steps of:

(a) coating a photothermographic imaging layer mated onto a moving support;

(b) forming a complement film comprising a precoated or uncoated support; end (c) laminating the complement film to the photothermographic imaging layer to place the photothermographic imaging layer between the support and the complement film, the complement film being laminated to the photothermographic imaging layer prior to exposure of the photothermographic imaging layer to yield the photothermographic film, the photothermographic film retaining any volatile material present in the photothermographic imaging layer generated when thermal energy is applied thereto to develop a latent image exposed on the photothermographic imaging layer.

20. A method as recited in claim 19 further comprising the step of:

controlling tint of the photothermographic film by separately adjusting a first tint of the support and a second tint of the complement film.

21. A method as recited in claim 19 further comprising the step of applying an adhesive between the complement film and the photothermographic imaging layer.

22. A method for making a photothermographic film with reduced edge peel back comprising the steps of:

(a) coating a photothermographic imaging layer coated onto a moving support;

(b) forming a complement film comprising a precoated or uncoated support having a thickness greater than 10 $\mu$m; and (c) laminating the complement film tote photothermographic imaging layer to place the photothermographic Imaging layer between the support and the complement film, the complement film being laminated to the photothermographic imaging layer prior to exposure of the photothermographic imagining layer to yield the photothermographic film.

23. A method as recited in claim 22 wherein:

the photothermographic turn retain; any volatile materials present in the photothermographic imaging layer generated when thermal energy is applied thereto to develop a latent image exposed on the photothermographic imaging layer.

24. A method as recited in claim 22 wherein:

the complement film a thickness of at least about 12.5 $\mu$m.

25. A photothermographic film comprising (a) a support, (b) a photothermographic imaging layer coated on the support, and (c) a complement film comprising a precoated or uncoated support that is laminated to the photothermographic imaging layer and generally confining the photothermographic imaging layer between the support and the complement film, die complement film being laminated to the photothermographic imaging layer prior to exposure of the photothermographic imaging layer, the complement film having a thickness greater than 10 $\mu$m.

26. A photothermographic film as recited in claim 25 wherein:

the complement film has a thickness oft least about 12.5 $\mu$m.

27. A photothermographic film as recited in claim 25 wherein:

the photothermographic film retains any volatile materials present in the photothermographic imaging layer generated when thermal energy is applied thereto to develop a latent image exposed on the photothermographic imaging layer.

28. A photothermographic film as recited in claim 25 further comprising:

at least one coating layer applied to the complement film on a side thereof opposite the photothermographic imaging layer.

29. A photothermographic film as recited in claim 28 wherein:

the at least one coating layer is a gloss control layer, a scratch resistant layer, an image receptor layer, a dye receptor layer, an ink receptive layer, a release layer, or a combination two or more thereof.

30. A method as recited in claim 22 further comprising the step of:

applying at least one coating layer applied to the complement film on a side thereof opposite the photothermographic imaging layer, the at least one coating being is a gloss control layer, a scratch resistant layer, an image receptor layer, a dye receptor layer, an ink receptive layer, a release layer, or a combination two or more thereof.

31. A method as recited in claim 22 further comprising the step of:

controlling tint of the photothermographic film by separately adjusting a first tint of to support and a second tint of the complement film.

32. A photothermographic film comprising:

(a) a support, (b) a photothermographic imaging layer coated on the support, and (c) a complement film comprising a precoated or uncoated support greater than 10 $\mu$m thick that is laminated to the photothermographic imaging layer and generally confining the photothermographic imaging layer between the support and the complement film, the complement film being laminated to the photothermographic imaging layer prior to exposure of the photothermographic imaging layer, the complement film retaining any volatile materials present in the photothermographic imaging layer generated when thermal energy is applied thereto to develop a latent image exposed on the photothermographic imaging layer.

33. A photothermographic film as recited in claim 32 further comprising an adhesive layer bonding the complement film to the photothermographic imaging layer.

34. A photothermographic film as recited in claim 32 further comprising:

a tie layer coated on the photothermographic imaging layer, the tie layer interfacing with the complement film.

35. A photothermographic film as recited in claim 32 further comprising:

an adhesive layer bonding the complement film to the tie layer.

36. A photothermographic film as recited in claim 32 further comprising:

at least one backside coating applied to the support.

37. A photothermographic film as recited in claim 36 wherein:

the at least one backside coating includes an antihatation dye.

38. A photothermographic film as recited in claim 36 wherein:

the at least one backside coating includes a transport matte agent.

39. A photothermographic film as recited in claim 36 wherein:

the at least one backside coating includes an anti-static agent.

40. A photothermographic film RS recited in claim 34 wherein:

the tie layer is coated simultaneously with the photothermographic imaging layer on the support.

41. A photothermographic film as recited in claim 34 wherein:

the tie layer is coated separately from the photothermographic imaging layer.

42. A photothermographic film as recited in claim 32 wherein the photothermographic imaging layer is coated onto the support with a carrier layer.

43. A photothermographic film as recited in claim 32 wherein:

the complement film is polyethylene terephthalate or polyethylene naphtalahte, or polycarbonate.

44. A photothermographic film as recited in claim 32 wherein:

the support is a polyester.

45. A photothermographic film as recited in claim 44 wherein:

the support is polyethylene terephthalate or polyethylene naphthalahte.

46. A photothermographic film as recited in claim 32 wherein:

the complement film is an extrudate applied directly to the photothermographic imaging layer while the extrudate was still molten.

47. A photothermographic film as recited in claim 34 wherein:

the complement film is an extrudate applied directly to the tie layer while the extrudate is still molten.

48. A photothermographic film as recited in claim 32 wherein:

the support has a thickness of about 7 mil (177.8 $\mu$m).

49. A photothermographic film as recited in claim 32 wherein:

the photothermographic imaging layer is a composite multilayer coating.

50. A photothermographic film as recited in claim 32 further comprising:

at least one coating layer applied to the complement film on a side thereof opposite the photothermographic imaging layer.

51. A photothermographic film as recited in claim 50 wherein:

the at learn one coating layer is a gloss control layer, a scratch resistant layer, an image receptor layer, a dye receptor layer, an ink receptive layer, a release layer, or a combination of two or more thereof.

52. A method far producing a developed image on a photothermographic film comprising the steps of:

(a) exposing to photothermographic film to generate a desired latent image thereon, the photothermographic film including a support, a complement film greater than 10 $\mu$m thick comprising a precoated or uncoated support that is laminated to the photothermographic film, and a photothermographic imaging layer residing therebetween;

(b) applying thermal energy to the photothermographic film to develop the latent image; and (c) retaining any volatile materials present in the photothermographic imaging layer generated during the step of applying thermal energy between the support web and the complement turn.

* * * * *

UNITED STATES PATENT AND TRADEMARK OFFICE

CERTIFICATE OF CORRECTION

PATENT NO. : 6,764,813 B2
DATED : July 20, 2004
INVENTOR(S) : Aparna V. Bhave et al.

It is certified that error appears in the above-identified patent and that said Letters Patent is hereby corrected as shown below:

Column 37,
Line 47, replace “me” with -- the --

Column 39,
Line 2, replace “stops” with -- steps --
Line 14, replace “mm” with -- film --
Line 25, replace “to” with -- the --
Line 26, replace “mated” with -- coated --
Line 57, replace “tote” with -- to the --
Line 66, replace “turn retain” with -- film retains --

Column 40,
Line 5, insert -- has -- after “film”
Line 15, replace “die” with -- the --
Line 56, replace “to” with -- the --

Column 42,
Line 32, replace “learn” with -- least --
Line 33, replace “turn” with -- film --

Signed and Sealed this

Twelfth Day of April, 2005

JON W. DUDAS
*Director of the United States Patent and Trademark Office*